United States Patent [19]

Mattson et al.

[11] Patent Number: 5,069,113

[45] Date of Patent: Dec. 3, 1991

[54] STACKED AND CROSS-CONNECTED RECIRCULATING FANS IN A SEMICONDUCTOR MANUFACTURING CLEANROOM

[75] Inventors: Brian J. Mattson; Chester N. Edwards, both of Boise, Id.

[73] Assignee: Micron Technology, Inc., Boise, Id.

[21] Appl. No.: 533,195

[22] Filed: Jun. 4, 1990

[63] Continuation-in-part of Ser. No. 433,155, Nov. 8, 1989, now U.S. Pat. No. 4,960,845.

[51] Int. Cl.[5] ..... F24F 13/00; F04B 17/00

[52] U.S. Cl. ..... 454/252; 417/423.5; 454/236; 454/187

[58] Field of Search ..... 98/33.1, 39.1, 34.6; 417/3, 423.5

[56] References Cited

U.S. PATENT DOCUMENTS 2,053,395 9/1936 Dodge ..... 98/39.1 X 2,996,973 8/1961 Boysen ..... 98/39.1 X

*Primary Examiner*—William E. Wayner

*Attorney, Agent, or Firm*—Stanley N. Protigal

[57] ABSTRACT

A pair of recirculating fans for semiconductor cleanroom use are stacked to allow each fan to service a smaller zone in the cleanroom than if the fans were placed side by side. Each fan controls the temperature, humidity, and particulate count for its own zone of the cleanroom, thereby allowing strict control of these parameters. The ductwork of the two fans are cross connected so that either fan can be maintained or repaired while the other fan services its own zone and the zone normally serviced by the off-line fan.

18 Claims, 5 Drawing Sheets

STACKED AND CROSS-CONNECTED RECIRCULATING FANS IN A SEMICONDUCTOR MANUFACTURING CLEANROOM

This application is a continuation-in-part of Ser. No. 07/433,155 filed Nov. 8, 1989 and now U.S. Pat. No. 4,960,845.

FIELD OF THE INVENTION

This invention relates to air handling equipment for ventilation systems. More specifically, it describes an improvement in the setup of recirculating fans employed in semiconductor manufacturing cleanrooms.

BACKGROUND OF THE INVENTION

It is well known that air quality must be strictly maintained in a cleanroom where semiconductors are manufactured. Due to the extremely small geometries on state-of-the-art random access memories and other semiconductors, microscopic impurities such as fibers, dust, and pollen found in normal environmental air will, if released in a manufacturing cleanroom, render any product produced unusable. Even fibers shed from the worker's clothes and skin cells sloughed off the workers in a cleanroom would normally make semiconductors produced in the presence of these particulates inoperative. In addition to particulate concerns, the temperature and humidity of the air must be strictly controlled to maximize product yield. For example, if the relative humidity drops significantly, static electricity discharges would likely destroy circuit elements on the semiconductors. Temperature changes cause variations in certain processes involved in making semiconductors, as well as affecting relative humidity. For these reasons, the air in a cleanroom must be constantly recirculated, purified, and conditioned.

Cleanrooms have different degrees of cleanliness, ranging from Class zero to Class 100,000, depending on the number of particles one micron or larger that are found in each cubic foot of air. As a comparison, typical unfiltered air has about one million particles one micron or larger in each cubic foot of air.

Various types of equipment have been used in the past to help remove particulates from objects or from the worker either before or after they enter the cleanroom. An example is an invention by Byrnes described in U.S. Pat. No. 4,624,690. This apparatus is used to remove particulates from smaller objects such as the worker's gloves, the worker's boots, or from wipes or other articles both before and after they enter the cleanroom. Air showers are also commonly used which remove particles from the entire worker before s/he enters the cleanroom.

One component found in manufacturing cleanrooms which aids in removing particulates from the air is a number of recirculating fans. Recirculating fans move air rapidly from the cleanroom, where the product is manufactured, through humidity and temperature regulators, to air filters, where the accumulated particulates shed by the workers and the equipment are removed, and back to the cleanroom. The recirculating fans also serve to keep the cleanroom pressurized, which helps to keep particulates from entering the cleanroom. To date, the recirculating fans have caused certain problems of their own, not the least of which are maintainability and the space they require.

Early layouts of manufacturing cleanrooms had one large fan servicing a single manufacturing bay, or a number of bays. Advantages of this layout included ease of installation, low installation cost, and relatively low maintenance. As manufacturing technology improved, however, it became necessary to more strictly control environmental conditions such as particulate count, temperature, and humidity of the air in the cleanroom, because as geometries decreased these parameters more greatly affected product yield. One method which helps achieve this end is to increase the number of fans so that only a portion of a bay, or "zone" of the bay, is serviced by a fan. As geometries continue to decrease, even finer control of environmental conditions is needed, which requires more fans to keep cleanroom conditions within the desired limits. This has created a space problem, as the fans and associated service areas will be larger than the zone they are servicing. Space requirements in a state-of-the-art cleanroom are already no small consideration, as it has been estimated that for every square foot of cleanroom floor space, three square feet of space are required for support equipment.

Maintainability of the fans is also a problem, as in present designs of manufacturing cleanrooms the entire cleanroom must be shut down in order to service a single fan. With more and more fans, the chance of a failure, which would require a shutdown of the cleanroom, also increases. Adding a backup fan would help the maintainability problem, but would compound the space problem.

SUMMARY OF THE INVENTION

An object of this invention is to provide an apparatus for recirculating air in a cleanroom which can be maintained without shutting down the cleanroom area serviced by the air recirculating apparatus. It is a further object to maintain a cleanroom environment in the cleanroom while the apparatus is being maintained.

Another object of this invention is to allow fans to service a smaller area in the cleanroom even though the footprint of the fans may not change. This will allow stricter control of temperature, humidity, and particulate parameters.

These objects of the present invention are attained by stacking a first fan on the top of a second fan and interconnecting the ductwork of the two fans. Stacking the fans in a vertical direction requires less space in a horizontal plane than would placing the fans side by side. This stacked design allows an individual fan to service a smaller zone than if the fans were installed horizontally. This allows greater control over uniform temperature, humidity, and particulates than if the fan serviced a larger zone in the cleanroom.

While the inventive configuration conserves space, the interconnection of the ductwork of the two fans allows either fan to be taken down for maintenance or repair while the other fan services the zone of the cleanroom normally serviced by the fan under repair. By using this apparatus, manufacturing in the cleanroom can continue while the fans are being maintained or repaired.

BRIEF DESCRIPTION OF THE DRAWINGS

The drawing Figures each show cross-sections of the invention.

FIG. 1 shows the two recirculating fans positioned above the cleanroom, and the ducting and dampers required for a complete system.

FIG. 2 shows the position of the dampers during normal operation when both fans are supplying air to their respective zones.

FIG. 3 shows the position of the dampers when the lower fan is being maintained or repaired and the upper fan is supplying air for both zones of the cleanroom.

FIG. 4 shows the position of the dampers when the upper fan is being maintained or repaired and the lower fan is supplying air for both zones of the cleanroom.

FIG. 5 shows the coil which controls the temperature of the air, the humidifier which controls the humidity of the air, and the filter which removes the particulates from the air.

DETAILED DESCRIPTION OF THE PREFERRED EMBODIMENT

Manufacturing cleanrooms in which semiconductors and pharmaceuticals are produced have different degrees of cleanliness, ranging from Class zero to Class 100,000. The class of a cleanroom is based on the number of particles one micron or larger that are found in each cubic foot of air. As a comparison, typical unfiltered air has about one million particles one micron or larger in each cubic foot of air.

Figure 1:
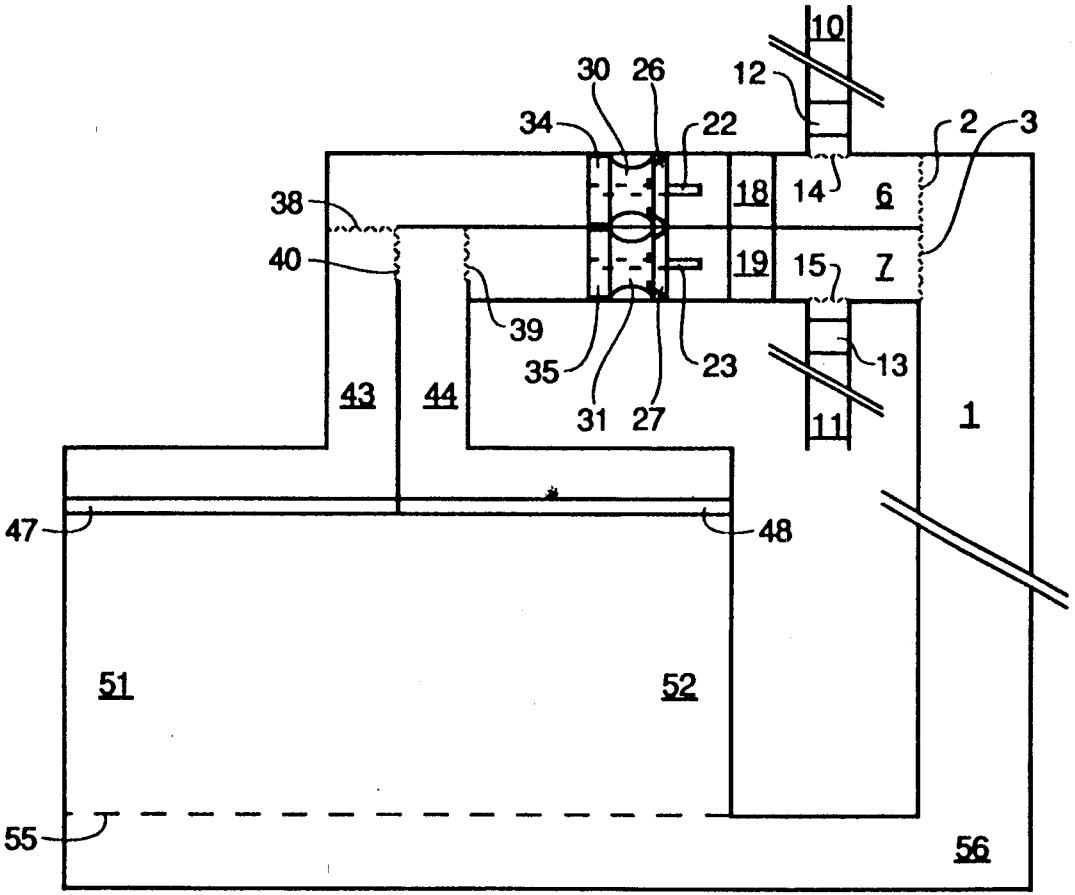
FIG. 1 shows the invention as it might be found in relation to the cleanroom itself and other supporting elements of the cleanroom.

FIG. 1 shows two recirculating fans 34, 35 positioned above two cleanroom zones 51, 52. Each fan is capable of supplying sufficient air to provide a filtered air supply and evacuate particulates for the class of cleanroom that is desired. In one preferred embodiment in which the invention was implemented, each fan generates an airflow of 14, 400 cfm (cubic feet per minute), or 410 $M^3$/minute. This results in an average air change in the cleanroom of once every 4.8 seconds. This particular cleanroom is an ASTM Class 1 cleanroom.

FIG. 1 also shows a number of dampers 2, 3, 14, 15, 38, 39, 40. In one preferred embodiment in which the invention was implemented, opposed blade dampers were used, each damper having a number of metal slats 56 cm (centimeters) long, 15.24 cm wide, and 19.05 mm (millimeters) thick with each end of the slat affixed laterally to a metal axle, each axle at each end of the slat being 12.7 mm in diameter and 50.8 cm long. Other types of dampers, such as parallel blade dampers, could be used equally well.

The assembled slats and axles are mounted on a frame such that the axles can be rotated in unison so that when a damper is closed the slats lie perpendicular to the flow of air to create an essentially solid wall in which each slat seals against an adjacent slat to prevent the flow of air past the damper. When the axles are rotated approximately 90 degrees, the slats lie parallel to the flow of air and do not overlap with adjacent slats, thereby allowing the free flow of air past the slats.

FIG. 1 shows the invention in a typical cleanroom setup. Note that for illustration purposes, all dampers 2, 3, 14, 15, 38, 39, 40, are shown in an open position, which would not be found during any operational mode. The description of FIG. 1 depicts the operation of the invention in a mode when fan 34 is supplying air to zone 51 and fan 35 is supplying air to zone 52 (hereafter "primary operation").

In FIG. 1, air enters intake 1 from cleanroom outlet 56 where it has been recirculated. Approximately half the air from air intake 1 enters a chamber 6 through intake damper 2. It then enters an air conditioner 18 where it is filtered and controlled for temperature and humidity. (Note that while the three parameters of particulate count, temperature, and humidity are usually controlled by a filter, a coil, and a humidifier respectively, the controlling elements are shown for simplicity in FIGS. 1, 2, 3, and 4 as a single unit while, in fact, they are usually separate elements. See FIG. 5 for a schematic representation of the filter, the coil, and humidifier as they might be found in the invention.) The air then passes between fan disk 26 and fan disk mount 30 to plug fan 34 where it is blown through an open fan outlet damper 38, passed a closed crossover damper 40 and into fan discharge duct 43. The air then travels through a high efficiency air particulate (hereafter "HEPA") filter 47. The HEPA filters, such as filter 47, are mounted in a filter panel (not shown) in the ceiling of the cleanroom. Air is admitted through HEPA filter 47 into cleanroom zone 51 where the air carries particulates through false floor 55, into cleanroom discharge duct 56 where it is recirculated into air intake 1 where the process is repeated.

At the same time, the remaining air from air intake 1 enters a chamber 7 through intake damper 3. It then enters an air conditioner 19 where it is filtered and controlled for temperature and humidity. The air then passes between fan disk 27 and fan disk mount 31 to plug fan 35 where it is blown through an open outlet damper 39, passed a closed crossover damper 40 and into fan discharge duct 44. The air then travels through a HEPA filter 48. The HEPA filters, such as filter 48, are mounted in a filter panel (not shown) in the ceiling of the cleanroom. Air admitted through HEPA filter 48 carries particulates through false floor 55, into cleanroom discharge duct 56 where it is recirculated into air intake 1 where the process is repeated.

Note that if additional air is necessary to keep the cleanroom pressurized, air can enter from the outside via make-up air duct 10 where it will pass through an air conditioner 12 where the air is filtered and controlled for temperature and humidity. The air will then pass by an open damper 14, into chamber 6 and from that point will follow the same path as recirculated air entering chamber 6 from intake 1. If outside air is not required, damper 14 will be closed. Similarly, air can enter chamber 7 from the outside via make-up air duct 11 where it will pass through an air conditioner 13 where the air is filtered and controlled for temperature and humidity. The air will then pass by an open damper 15 and from that point will follow the same path as recirculated air entering chamber 7 from intake 1. If outside air is not required, damper 15 will be closed. In the descriptions of subsequent figures, the make-up air system is not mentioned, and it can be assumed that the make-up air dampers can be either open or closed as required to keep the cleanroom pressurized.

Figure 2:
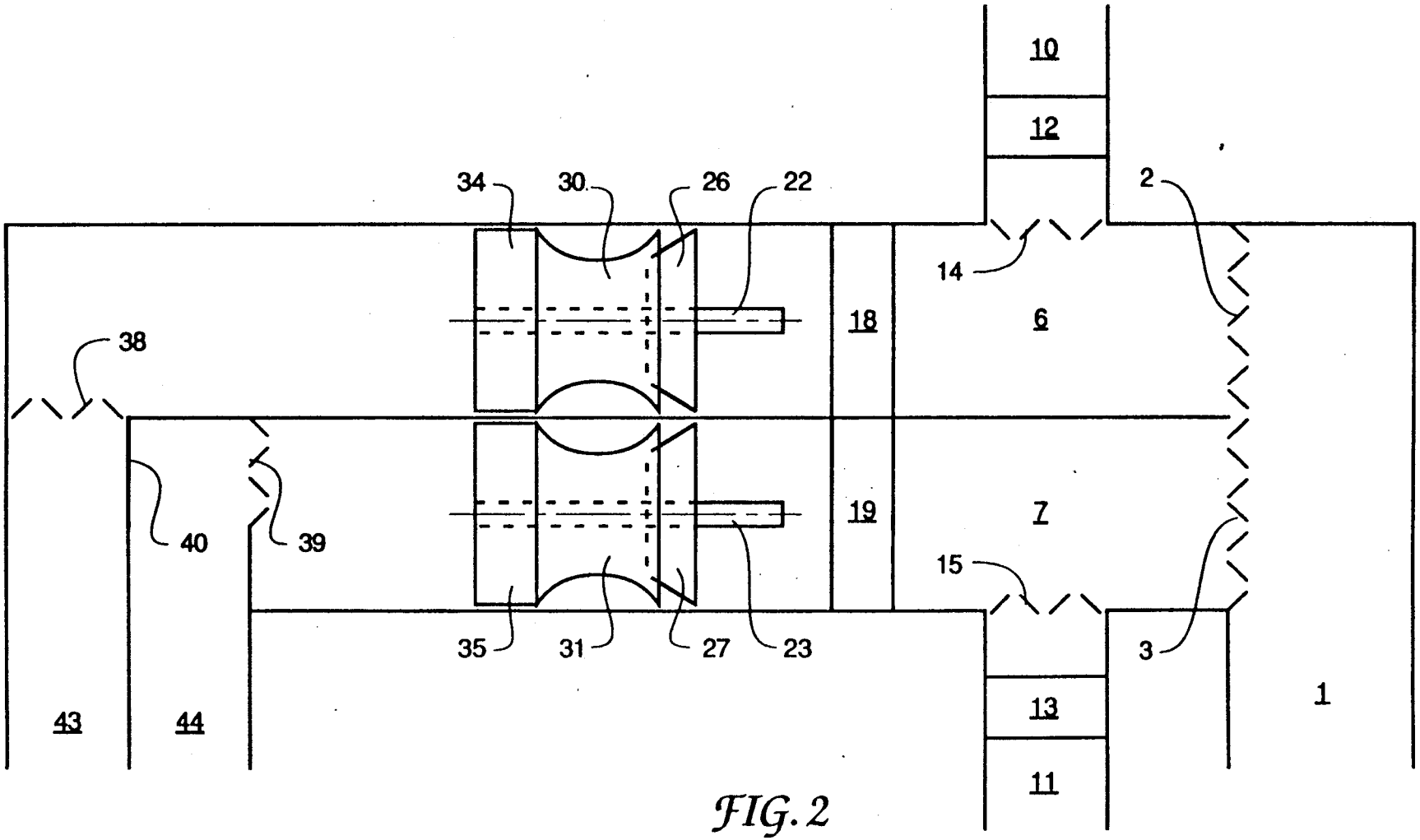
FIGS. 2, 3, and 4 show the invention set for a different mode, depending on if a fan is being maintained.
Figure 3:
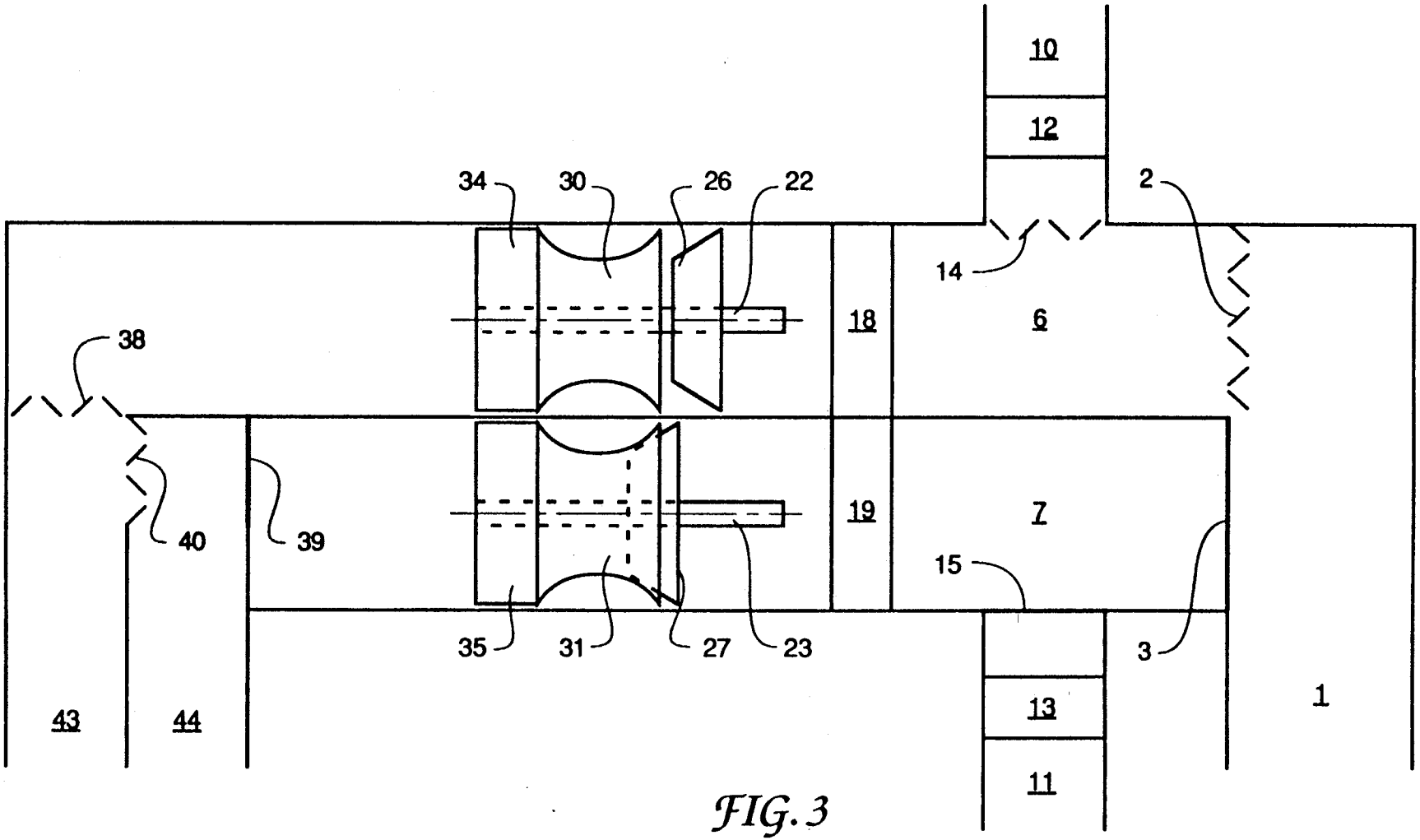
Figure 4:
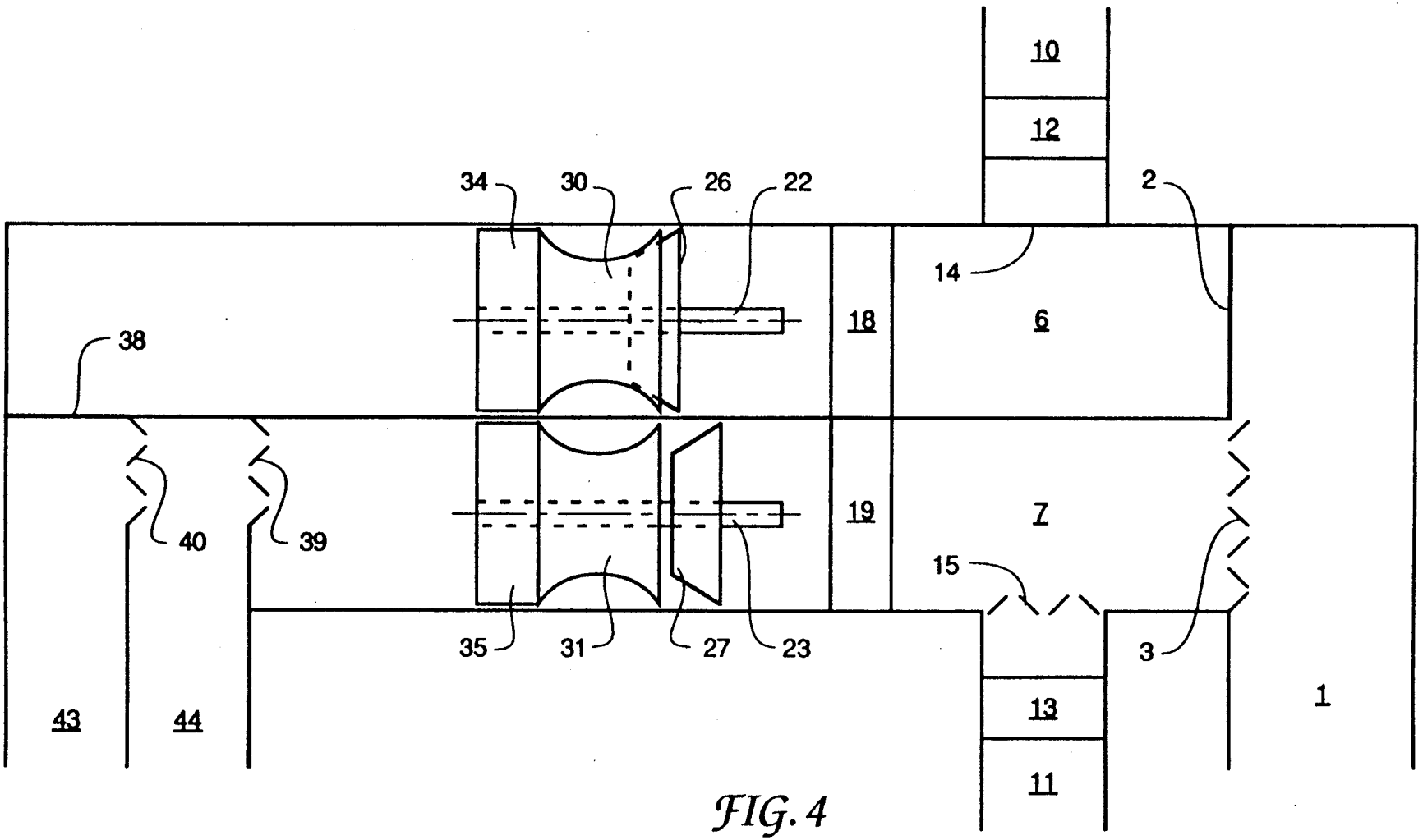

FIGS. 2, 3, and 4 show the apparatus during different modes of operation. Improvements over prior art include a stacked design and a unique damper arrangement. The stacked configuration of the apparatus allows a fan to service a smaller zone in a cleanroom than if the fans were stacked side by side. This allows greater control over temperature and humidity. Also, the ducting design shown allows either fan to service the area normally serviced by the other fan. This is an advantage over prior art in that manufacturing in the cleanroom can continue even though the fans are being maintained or repaired or if the HEPA filters are being changed.

FIGS. 2, 3, and 4 describe the operation of the dampers and the disk. The disk and disk mount, which control the amount of air passing through the fan, was, for the present embodiment of the invention, purchased from Brod & McClung-Pace Co. of Portland, Oregon. Similar designs, or other methods for controlling the amount of air entering the fans, should work equally well. FIG. 2 shows the recirculating fan assembly during primary operation. Air is ducted through an air intake 1, through an open intake damper 2, and into chamber 6. The air then passes through an air conditioner 18 where it is filtered and set to the proper temperature and humidity. The air then passes between fan disk 26 and fan disk mount 30, through plug fan 34, through an open outlet damper 38, passed a closed crossover damper 40, and out outlet 43. The air then passes into the cleanroom zone through a HEPA filter.

At the same time, air is ducted through air intake 1, through an open intake damper 3, and into chamber 7. The air then passes through an air conditioner 19 where it is filtered and set to the proper temperature and humidity. The air then passes between fan disk 27 and fan disk mount 31, through plug fan 35, through an open outlet damper 39, passed closed crossover damper 40, and out outlet 44. The air then passes into the cleanroom zone through a HEPA filter.

FIG. 3 shows the recirculating fan assembly when fan system 35 is shut down for maintenance and fan 34 is supplying the air normally supplied by fan 35 (hereafter "secondary operation 1"). Air is ducted through an air intake 1, passed a closed intake damper 3, through an open intake damper 2, and into chamber 6. The air then passes through an air conditioner 18 where it is filtered and set to the proper temperature and humidity. The air then passes between fan disk 26 and fan disk mount 30. Note that the distance between fan disk 26 and fan disk mount 30 has increased from the distance set during primary operation to allow approximately twice as much air to pass through. This is accomplished by moving fan disk 26 away from fan disk mount 30 on disk spindle 22. This additional space lets more air pass through plug fan 34, which allows fan 34 to supply the air normally supplied by both plug fan 34 and plug fan 35 without a reduction in the total air flow through the cleanroom. After the air passes between fan disk 26 and fan disk mount 30, it passes through plug fan 34, and through an open fan outlet damper 38. Approximately half the air moves through fan outlet 43 and into the cleanroom zone through a HEPA filter, while the remaining air passes through an open crossover damper 40, passed a closed fan outlet damper 39, out outlet 44 and into the cleanroom zone through a HEPA filter. During secondary operation 1, plug fan 35 is shut down for maintenance or repair. Intake damper 3 is closed to prevent any air from entering chamber 7.

FIG. 4 shows the recirculating fan assembly when fan 34 is shut down for maintenance and fan 35 is supplying the air normally supplied by both fan 34 and fan 35 (hereafter "secondary operation 2"). Air is ducted through an air intake 1, through an open intake damper 3, and into chamber 7. The air then passes through an air conditioner 19 where it is filtered and set to the proper temperature and humidity. The air then passes between fan disk 27 and fan disk mount 31. Note that the distance between fan disk 27 and fan disk mount 31 has increased from the distance set during primary operation to allow approximately twice as much air to pass through. This is accomplished by moving fan disk 27 laterally away from fan disk mount 31 on disk spindle 23. This additional space lets more air pass through plug fan 35, which allows fan 35 to supply the air normally supplied by both plug fan 34 and plug fan 35 without a reduction in the total air flow. After the air passes between fan disk 27 and fan disk mount 31, it passes through plug fan 35, and through an open outlet damper 39. Approximately half the air moves through outlet 44 and into the cleanroom through HEPA filter 48, while the remaining air passes through an open crossover damper 40, passed a closed outlet damper 38, out outlet 43 and into the cleanroom through HEPA filter 47. During secondary operation 2, plug fan 34 is shut down for maintenance or repair. Intake damper 2 is closed to prevent any air from entering chamber 6.

Figure 5:
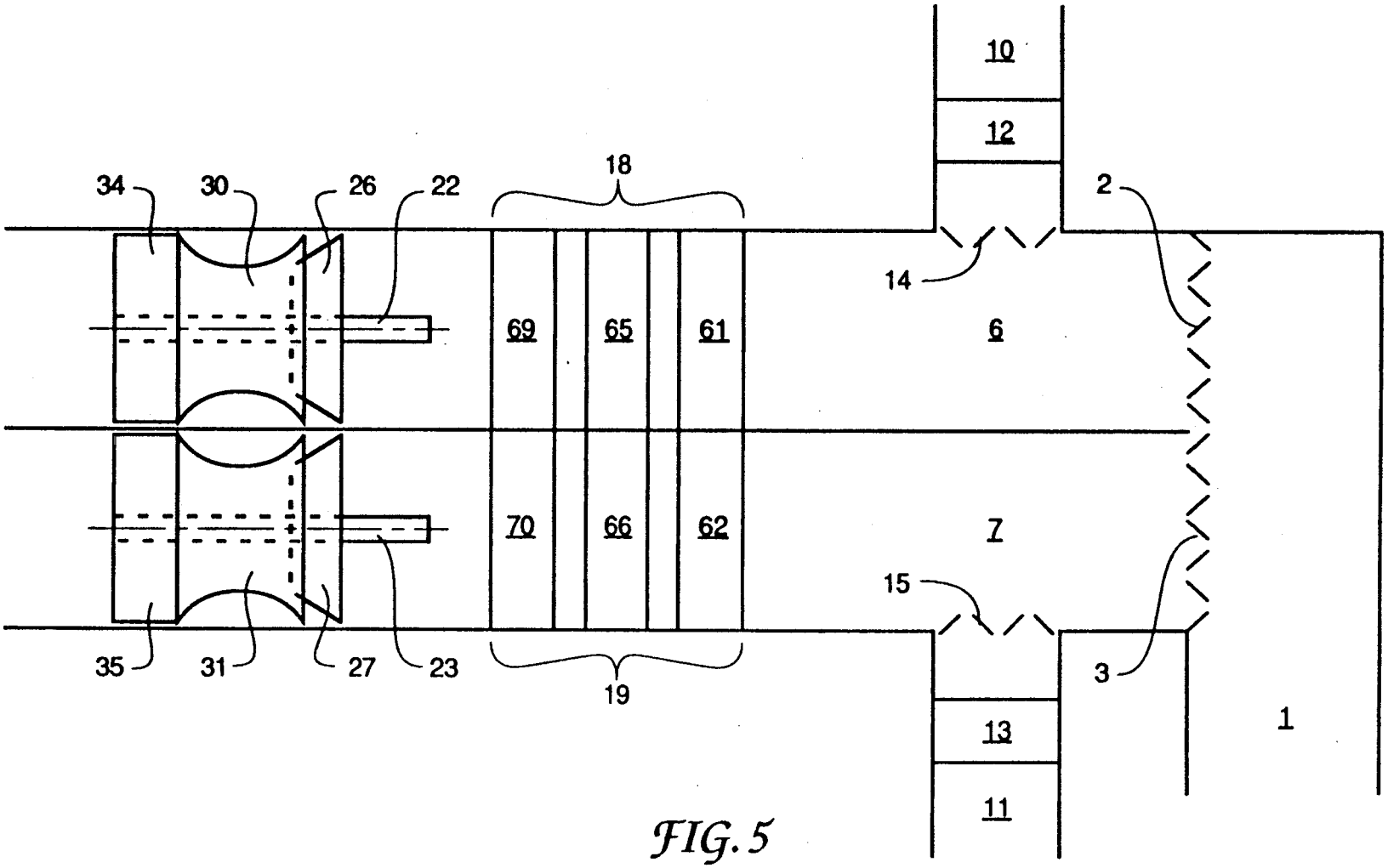
FIG. 5 details the air conditioners shown in FIGS. 1, 2, 3, and 4.

FIG. 5 shows a schematic representation of the individual elements of the two air conditioners. After entering chamber 6, the air passes through a HEPA filter 61 where particulates are removed. The air is then controlled for temperature via a coil 65, and humidified with a humidifier 69, then continues through the system as described above. After entering chamber 7, the air passes through a HEPA filter 62 where particulates are removed. The air is then controlled for temperature via a coil 66, and humidified with a humidifier 70, then continues through the system as described above.

What has been described is a very specific configuration of the invention, as applied to a particular cleanroom facility. Clearly, variations can be made to the original design for adapting the invention to other cleanroom facilities. For example, instead of using a fan disk and a fan disk mount to control the amount of air passing through the fan, it would be equally possible to use a variable speed fan and increase the speed of the fan to an appropriate level in order to double its output when the other fan is shut down. Likewise, the recirculating fan apparatus can be used for moving gasses other than air in applications other than a semiconductor cleanroom. Also, instead of moving the disk along the disk spindle, it is possible to firmly connect the disk to the spindle and move the spindle which, in turn, would move the disk, or to eliminate the spindle and move the disk along a track. Therefore, the invention should be read as limited only by the appended claims.

We claim:

1. An apparatus for moving a gas comprising:

a) a first fan and a second fan;

b) a first fan chamber housing the first fan and a second fan chamber housing the second fan, the fan chambers being stacked vertically;

c) an intake and an outlet connected to the first fan chamber and an intake and an outlet connected to the second fan chamber;

d) means for preventing the backflow of the gas back through the first and second fan outlets; and e) means for controlling the flow of gas between the first and second fan outlets such that the gas moving apparatus can be set to any of the three following conditions as desired: 1) the gas flows from the first fan outlet to the second fan outlet, thereby allowing the first fan to supply the gas to both the first fan outlet and the second fan outlet; 2) the gas flows from the second fan outlet to the first fan outlet, thereby allowing the second fan to supply the gas to both the second fan outlet and the first fan outlet; 3) gas flow between the first fan outlet and the second fan outlet is prevented.

wherein the apparatus, when in an operation in which one fan is supplying the gas normally supplied by the other fan, has means for allowing the fan supplying the gas normally supplied by the other fan to output a total quantity of gas approximately equal to that which would be output when the gas moving apparatus is in an operational mode in which both fans are supplying gas.

2. An apparatus according to claim 1 wherein:

the means for allowing the operational fan to supply a quantity of gas approximately equal to that which would be supplied when the gas moving apparatus is in an operation mode where each fan is supplying gas comprises a circular wedge-shaped disk, a mount for the disk such that when the disk rests against the mount an essentially airtight seal is achieved and as the distance from the disk to the mount increases the more gas is able to pass between the disk and the mount, and means for increasing and decreasing the distance between the disk and the mount; and the means for increasing and decreasing the distance between the disk and the mount permits control of the amount of gas allowed to pass between the disk and the mount, and further permits the stoppage of the flow of gas passing between the disk and the mount.

3. An apparatus according to claim 2 wherein:

the means for increasing and decreasing the distance between the disk and the mount includes a spindle whereon the disk is solidly mounted and means for moving the spindle such that when the spindle is moved the disk also moves.

4. An apparatus according to claim 2 wherein:

the means for increasing and decreasing the distance between the disk and the mount includes a spindle and means for attaching the disk to the spindle such that the disk can slide back and forth along the spindle such that when the disk is moved along the spindle, the distance between the disk and the mount changes.

5. An apparatus according to claim 1 wherein:

the means for allowing the operational fan to supply a quantity of gas approximately equal to that which would be supplied when the gas moving apparatus is in an operation mode where each fan is supplying gas comprises means for increasing the speed of the operating fan thereby approximately doubling the amount of gas output.

6. An apparatus according to claim 1 further comprising:

means for independently conditioning the gas moved by each fan with respect to the temperature, with respect to the humidity, with respect to the particulate count, or with respect to any combination of temperature, humidity, or particulate count between the point where the gas first enters the fan chamber and the point that the gas leaves the outlet.

7. Air handler for supplying air to an environment in which positive exchange on a substantially continuous basis is required, and in which plural air supply fan are provided for supplying air to plural areas within the environment, wherein the air handler includes:

a) a first fan and a second fan;

b) a first fan chamber housing the first fan and a second fan chamber housing the second fan, the fan chambers being stacked vertically;

c) an intake and an outlet connected to the first fan chamber and an intake and an outlet connected to the second fan chamber;

d) means for preventing the backflow of the air back through the first and second fan outlets; and e) means for controlling the flow of air between the first fan outlet and the second fan outlet such that the air handler can be set to any of the three following conditions as desired: 1) the air flows from the first fan outlet to the second fan outlet, thereby allowing the first fan to supply the air to both the first fan outlet and the second fan outlet; 2) the air flows from the second fan outlet to the first fan outlet, thereby allowing the second fan to supply the air to both the second fan outlet and the first fan outlet; 3) air flow between the first fan outlet and the second fan outlet is prevented, wherein the apparatus, when in an operation in which one fan is supplying the air normally supplied by the other fan, has means for allowing the fan supplying the air normally supplied by the other fan to output a total quantity of air approximately equal to that which would be output when the air moving apparatus is in an operational mode in which both fans are supplying air.

8. An apparatus according to claim 7 including:

the means for allowing the operational fan to supply a quantity of air approximately equal to that which would be supplied when the air handler is in an operation mode where each fan is supplying air comprises a circular wedge-shaped disk, a mount for the disk such that when the disk rests against the mount an essentially airtight seal is achieved and as the distance from the disk to the mount increases the more air is able to pass between the disk and the mount, and means for increasing and decreasing the distance between the disk and the mount; and the means for increasing and decreasing the distance between the disk and the mount permits control of the amount of air allowed to pass between the disk and the mount, and further permits the stoppage of the flow of air passing between the disk and the mount.

9. An apparatus according to claim 8 wherein:

the means for increasing and decreasing the distance between the disk and the mount includes a spindle whereon the disk is solidly mounted and means for moving the spindle such that when the spindle is moved the disk also moves.

10. An apparatus according to claim 8 wherein:

the means for increasing and decreasing the distance between the disk and the mount includes a spindle and means for attaching the disk to the spindle such that the disk can slide back and forth along the spindle such that when the disk is moved along the spindle, the distance between the disk and the mount changes.

11. An apparatus according to claim 7 wherein:

the means for allowing the operational fan to supply a quantity of air approximately equal to that which would be supplied when the air moving apparatus is in an operation mode where each fan is supplying air comprises means for increasing the speed of the operating fan thereby approximately doubling the amount of air output.

12. An apparatus according to claim 7 further including:

means for independently conditioning the air moved by each fan with respect to the temperature, with respect to the humidity, with respect to the particulate count, or with respect to any combination of temperature, humidity, or particulate count between the point where the air first enters the fan chamber and the point that the air leaves the outlet.

13. Classroom air handler for supplying air on a substantially continuous basis is required, wherein the air handler includes:

a) a first fan and a second fan;

b) a first fan chamber housing the first fan and a second fan chamber housing the second fan, the fan chambers being stacked vertically;

c) an intake and an outlet connected to the first fan chamber and an intake and an outlet connected to the second fan chamber;

d) means for preventing the backflow of the air back through the first fan outlet, and means for preventing the backflow of the air back through the second fan outlet; and e) means for controlling the flow of air between the first fan outlet and the second fan outlet such that the air handler can be set to any of the three following conditions as desired: 1) the air flows from the first fan outlet to the second fan outlet, thereby allowing the first fan to supply the air to both the first fan outlet and the second fan outlet; 2) the air flows from the second fan outlet to the first fan outlet, thereby allowing the second fan to supply the air to both the second fan outlet and the first fan outlet; 3) air flow between the first fan outlet and the second fan outlet is prevented.

wherein the apparatus, when in an operation in which one fan is supplying the air normally supplied by the other fan, has means for allowing the fan supplying the air normally supplied by the other fan to output a total quantity of air approximately equal to that which would be output when the air moving apparatus is in an operational mode in which both fans are supplying air.

14. An apparatus according to claim 13 wherein:

the means for allowing the operational fan to supply a quantity of air approximately equal to that which would be supplied when the air handler is in an operation mode where each fan is supplying air comprises a circular wedge-shaped disk, a mount for the disk such that when the disk rests against the mount an essentially airtight seal is achieved and as the distance from the disk to the mount increases the more air is able to pass between the disk and the mount, and means for increasing and decreasing the distance between the disk and the mount; and the means for increasing and decreasing the distance between the disk and the mount permits control of the amount of air allowed to pass between the disk and the mount, and further permits the stoppage of the flow of air passing between the disk and the mount.

15. An apparatus according to claim 14 wherein:

the means for increasing and decreasing the distance between the disk and the mount includes a spindle whereon the disk is solidly mounted and means for moving the spindle such that when the spindle is moved the disk also moves.

16. An apparatus according to claim 14 wherein:

the means for increasing and decreasing the distance between the disk and the mount includes a spindle and means for attaching the disk to the spindle such that the disk can slide back and forth along the spindle such that when the disk is moved along the spindle, the distance between the disk and the mount changes.

17. An apparatus according to claim 13 wherein:

the means for allowing the operational fan to supply a quantity of air approximately equal to that which would be supplied when the air moving apparatus is in an operation mode where each fan is supplying air comprises means for increasing the speed of the operating fan thereby approximately doubling the amount of air output.

18. An apparatus according to claim 13 further including:

means for independently conditioning the air moved by each fan with respect to the temperature, with respect to the humidity, with respect to the particulate count, or with respect to any combination of temperature, humidity, or particulate count between the point where the air first enters the fan chamber and the point that the air leaves the outlet.

* * * * *

UNITED STATES PATENT AND TRADEMARK OFFICE

CERTIFICATE OF CORRECTION

PATENT NO. : 5,069,113
DATED : December 3, 1991
INVENTOR(S) : Mattson et al.

It is certified that error appears in the above-identified patent and that said Letters Patent is hereby corrected as shown below:

Title page,
Item [63], please delete "Continuation-in-part of Ser. No. 433,155, Nov. 8, 1989, now U.S. Pat. No. 4,960,845."

Signed and Sealed this

Twenty-seventh Day of January, 2004

JON W. DUDAS
*Acting Director of the United States Patent and Trademark Office*